FIG. 9.
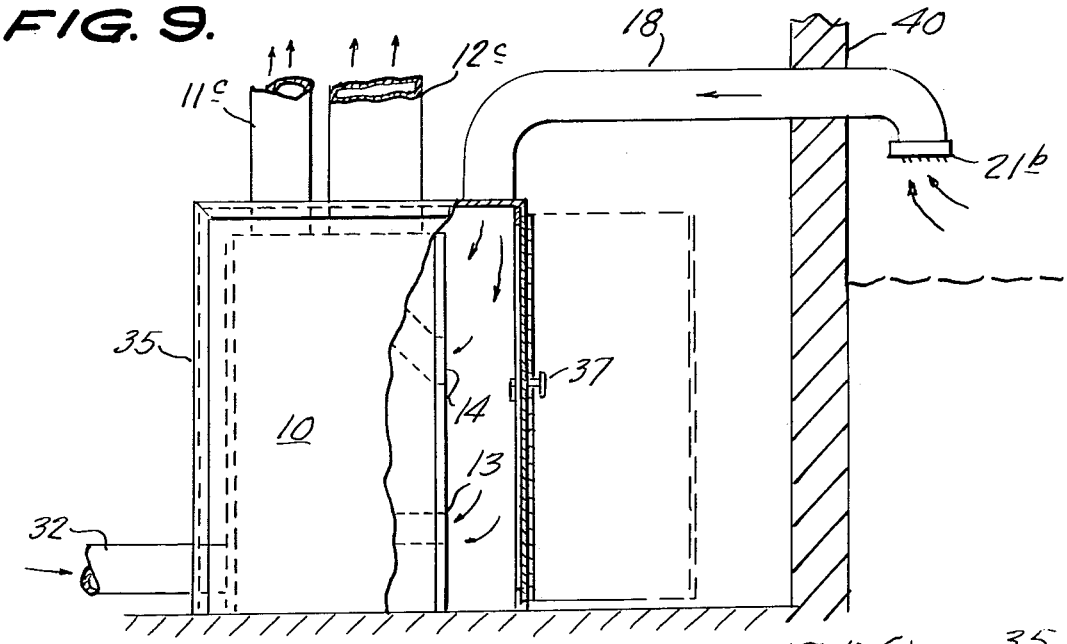
FIG. 10.
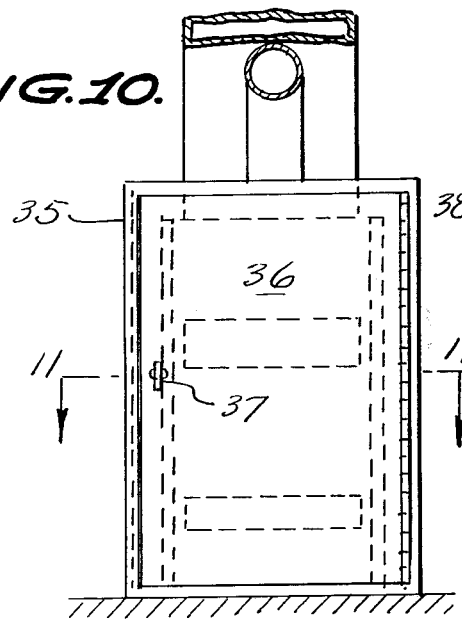
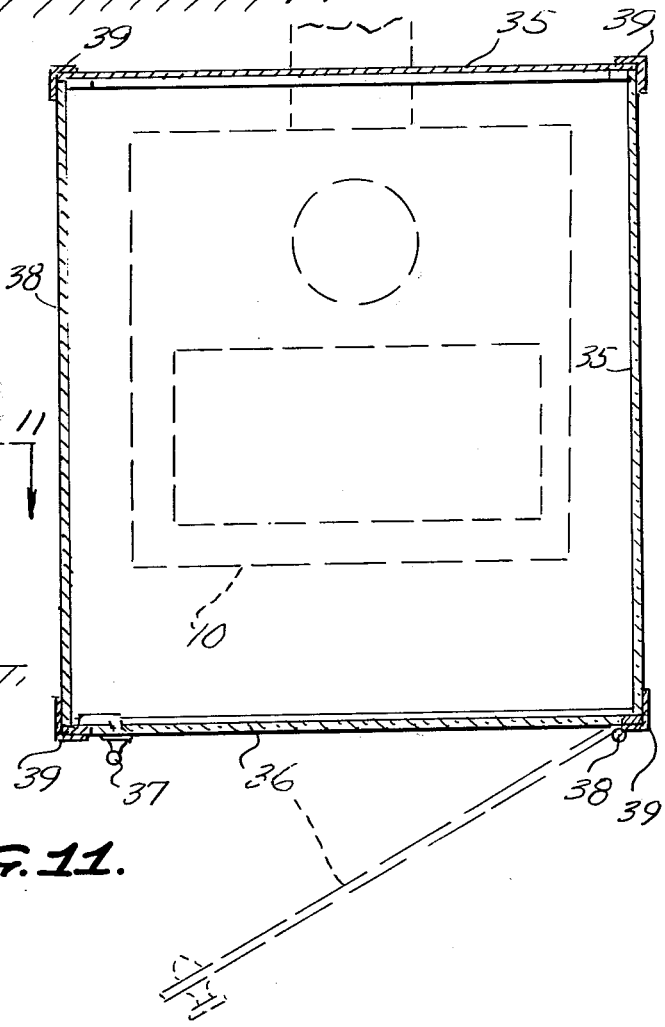
FIG. 11.

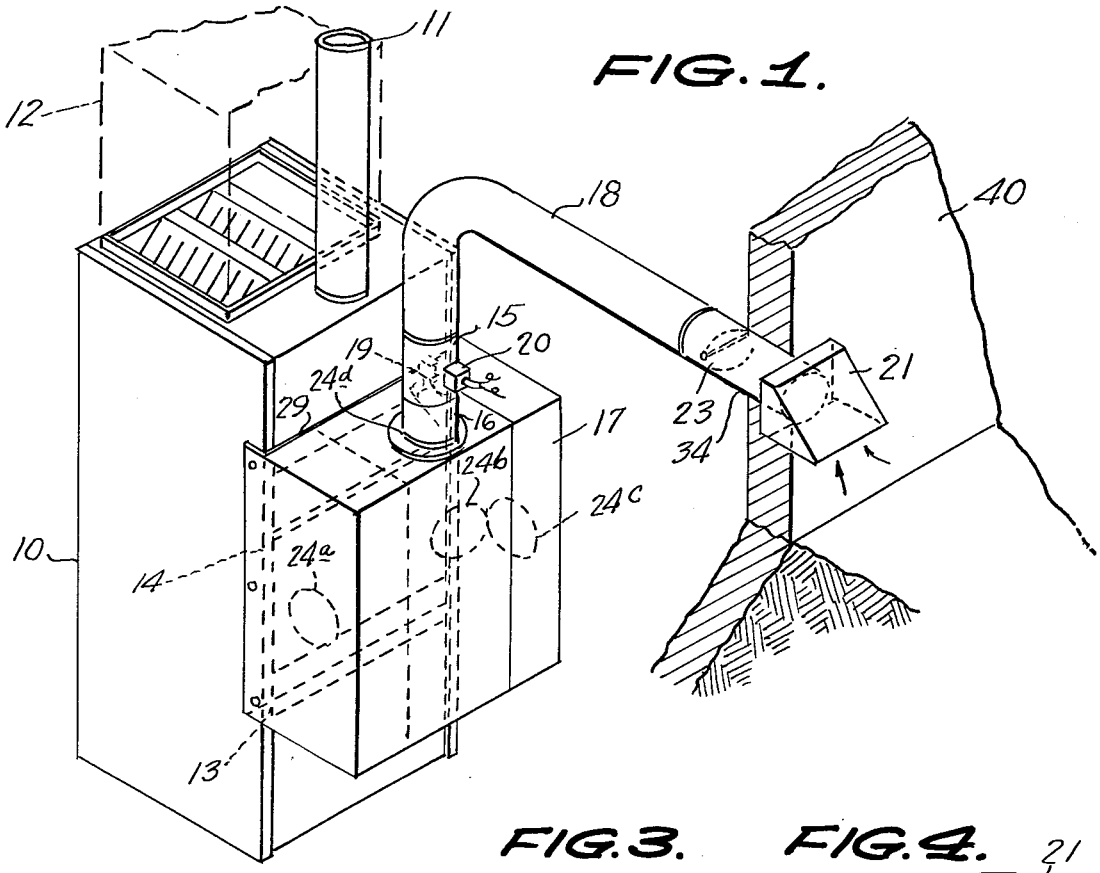
FIG. 1.
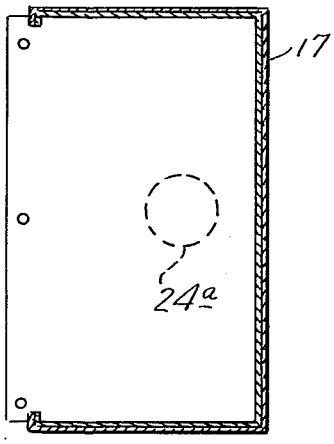
FIG. 2.
FIG. 3.
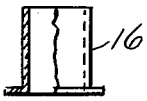
FIG. 4.
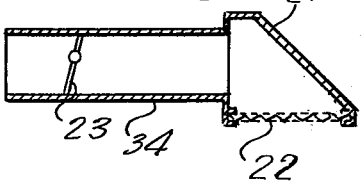
FIG. 5.
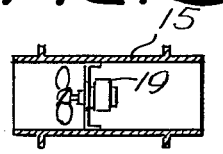
FIG. 6.
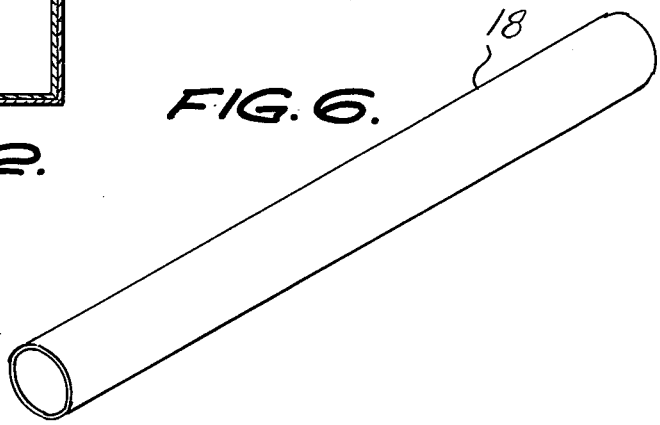

ENERGY CONSERVATION KIT FOR HOUSEHOLD FURNACES

BACKGROUND OF THE INVENTION

1. Field of the Invention

This invention relates to energy conservation devices and more particularly relates to the conversion of home or light commercial heating systems to more efficient operation with respect to the consumption of fossil fuel.

2. The Prior Art

Despite the energy crisis which presently confronts the world and our nation, there has been little if anything done to eliminate or improve the wasteful methods presently in use for heating dwelling houses, resulting in an unnecessarily extravagant consumption of fossil fuel which is already in short supply. While various types of furnaces have been proposed in the past, which allegedly result in more efficient operation, the real problem is to convert the already existing hundreds of thousands of furnaces to a more efficient operation. Typical of the various schemes proposed in the prior art are those set forth in the following patents:

U.S. Pat. Nos.

686,393 — Dawson
1,180,691 — Bower
1,579,384 — Murray
1,752,663 — Fagan
2,619,022 — Hergenrother
2,752,816 — Ryder
2,764,972 — Ryder
2,788,943 — Fauser, Jr.
3,064,638 — Bauer
3,092,320 — Powers
3,211,079 — Carlson Foreign Pat. Nos.

France — 504,705
Great Britain — 217,701

OBJECTS AND SUMMARY OF THE INVENTION

It is a principal object of the present invention to convert presently existing home heating and light commercial systems employing fossil fuel to more efficient operation.

A more specific object of the present invention is to provide a kit for economically and expeditiously converting furnaces utilizing fossil fuel to a more efficient operation, without modifying the structure of the heating unit.

Another object of the present invention is to provide a kit for converting heating systems employing fossil fuel to a more efficient operation and which kit is readily adaptable to several different types of heating systems.

The present invention achieves these and other objects by providing a kit which may be readily attached to a conventional furnace of the gas or oil type by enabling the furnace to utilize untreated outside air to support the combustion process and meet the air requirements of the draft diverter. In order for a fossil fuel furnace to function, combustion must occur by igniting a mixture of the fossil fuel (oil or gas) with air. In presently existing furnaces, both of the oil and gas type, the air which is utilized to support the combustion process and the air needed to supply the draft diverter is taken directly from the air within the home. This air, obviously, has already been previously heated and/or filtered and/or humidified. Once this air has been used, it is exhausted up the chimney to the outdoors and replaced within the structure by an infiltration of cold outside air which must again be heated, filtered and humidified.

It has been estimated by the heating industry that a fossil fuel furnace generally causes two and one-half to three air changes per hour to occur in the average dwelling. An air change has been defined as the replacement of the total volume of air, in cubic feet, contained within the dwelling. Thus, it can be seen that substantial waste occurs by reason of the necessity, for reheating, refiltering and rehumidifying cold air from the outside as each air change occurs.

In the present invention, an enclosure (or plenum) is provided to enclose the air intake openings of the furnace from the already processed household air and a conduit system is provided to bring in air directly from outside the dwelling to the plenum to provide the air requirements for both the combustion process and the draft diverter.

DESCRIPTION OF THE DRAWINGS

FIG. 1 is a perspective view of the kit of the present invention applied to a gas or oil fired furnace.

FIG. 2 is a sectional view of the enclosure or plenum component of the kit.

FIG. 3 is a sectional view of a connection component of the kit.

FIG. 4 is a sectional view of the outside air intake component of the kit.

FIG. 5 is a sectional view of a booster fan assembly needed when duct pressure becomes too high.

FIG. 6 is a perspective view of a section of fixed or flexible air duct to be used with the kit.

FIG. 9 is a side elevation, partly in section, illustrating another type of enclosure or plenum which can be supplied with the kit of the present invention.

FIG. 10 is a front elevation of the embodiment shown in FIG. 9.

FIG. 11 is a section taken on the line 11—11 in FIG. 10 looking in the direction of the arrows.

DETAILED DESCRIPTION OF THE INVENTION

Figure 7:
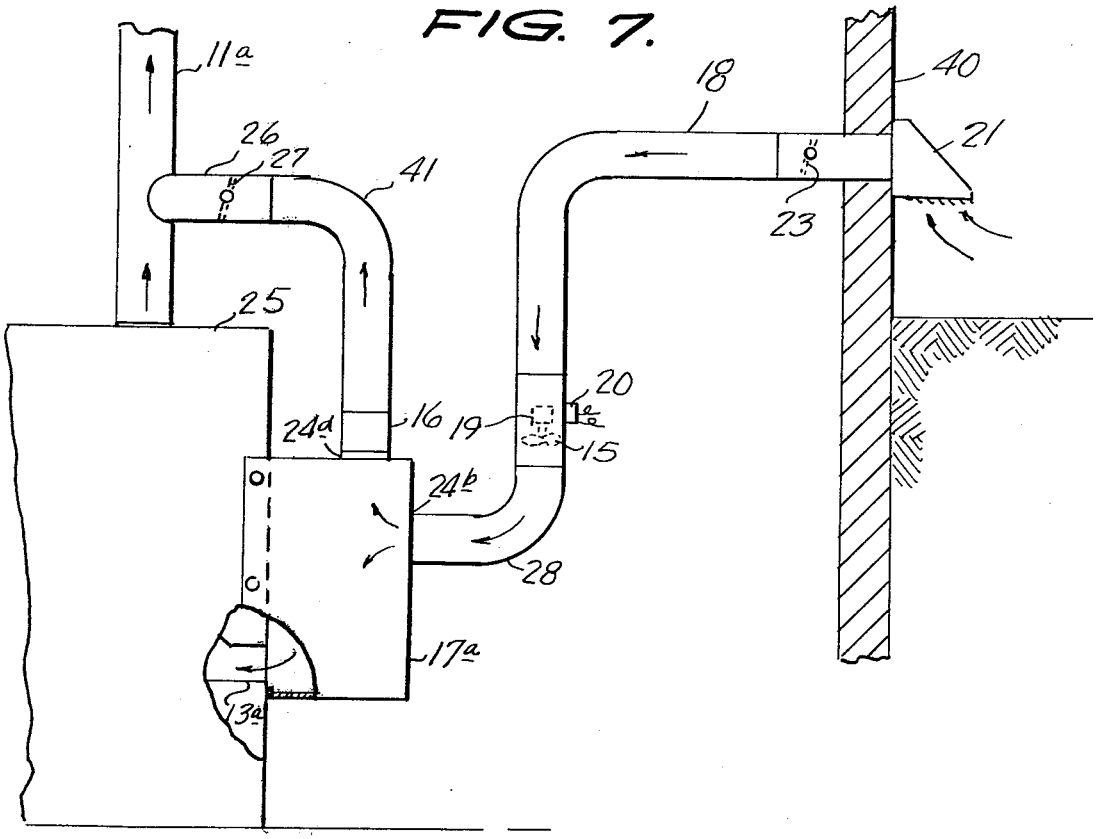
FIG. 7 is an elevation of a slightly different version of the kit of the present invention applied to a furnace with no built-in draft diverter.
Figure 8:
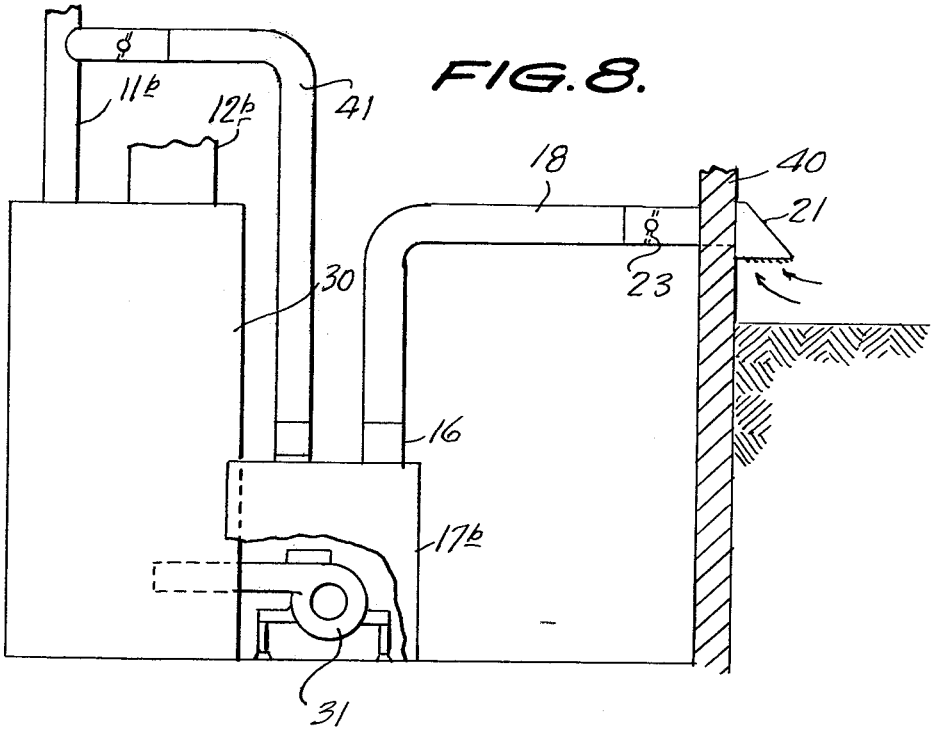
FIG. 8 is an elevation of a slightly different version of the kit of the present invention applied to a conversion type oil-burner furnace.

Referring to the drawings, wherein like reference numerals designate like components throughout the several figures thereof, and particularly to FIG. 1, there is illustrated a conventional furnace 10 having a flue 11 and heating supply duct 12. The furnace 10 is of the modern type which includes an air inlet 13 to the combustion chamber and an air inlet 14 to the draft diverter. As is well known, the function of the draft diverter is to slow down the velocity of the hot flue exhaust gases and to prevent the pilot light's being turned out when air is forced down the chimney. As explained above, the purpose of the present invention is to supply air from outside the dwelling to the furnace through both the air inlets 13 and 14 rather than utilizing air which has already been heated, filtered and humidified. To this end, 2. The kit set forth in claim 1 wherein said means for communicating comprises at least one section of duct.

3. The kit set forth in claim 2 further including air intake means adapted to be attached to said means for communicating and to be disposed outside said structure.

4. The kit set forth in claim 1 wherein said means for sealing off comprises a prefabricated room-like structure for at least partially surrounding said furnace.

5. The kit set forth in claim 4 wherein said room-like structure includes door means to gain access to said furnace for servicing.

6. The kit set forth in claim 1 wherein said plenum is provided with at least one knockout section for permitting said means for communicating to be attached thereto in communication with the interior of said plenum.

7. A kit for converting fossil fuel type heating furnaces disposed within a structure and having a combustion chamber air inlet and a draft diverter air inlet, to more efficient operation with respect to fuel consumption, comprising:

(a) integral structural means having one open side, dimensioned so as to fit over both said air inlets and seal said air inlets from the ambient air surrounding said furnace;

(b) means for attaching said structural means to said furnace in said sealing relationship;

(c) at least one section of duct adapted to be attached at one end to said structural means in communication with the interior thereof; and (d) air intake means for bringing in air from outside said structure to the end of said section of duct removed from the end adapted to be attached to said structural means.

* * * * *

UNITED STATES PATENT OFFICE

CERTIFICATE OF CORRECTION

Patent No. 4,121,562 Dated October 24, 1978

Inventor(s) Frank S. Grott

It is certified that error appears in the above-identified patent and that said Letters Patent are hereby corrected as shown below:

Column 5, lines 7 through 12, inclusive, representing Claims 4 and 5, please delete in their entirety as shown below:

"4. The kit set forth in claim 1 wherein said means for sealing off comprises a prefabricated room-like structure for at least partially surrounding said furnace."

"5. The kit set forth in claim 4 wherein said room-like structure includes door means to gain access to said furnace for servicing."

Column 5, line 13, please delete "Claim 6" to read --Claim 4--;

Column 6, line 1, please delete "Claim 7" to read --Claim 5--.

On the title page, "7 Claims" should read -- 5 Claims --.

Signed and Sealed this

Third Day of July 1979

[SEAL]

Attest:

Attesting Officer

LUTRELLE F. PARKER

Acting Commissioner of Patents and Trademarks

UNITED STATES PATENT OFFICE

CERTIFICATE OF CORRECTION

Patent No. 4,121,562 Dated October 24, 1978

Inventor(s) Frank S. Grott

It is certified that error appears in the above-identified patent and that said Letters Patent are hereby corrected as shown below:

Column 5, lines 7 through 12, inclusive, representing Claims 4 and 5, please delete in their entirety as shown below:

"4. The kit set forth in claim 1 wherein said means for sealing off comprises a prefabricated room-like structure for at least partially surrounding said furnace."

"5. The kit set forth in claim 4 wherein said room-like structure includes door means to gain access to said furnace for servicing."

Column 5, line 13, please delete "Claim 6" to read --Claim 4--;

Column 6, line 1, please delete "Claim 7" to read --Claim 5--.

On the title page, "7 Claims" should read -- 5 Claims --.

Signed and Sealed this

Third Day of July 1979

[SEAL]

Attest:

LUTRELLE F. PARKER

Attesting Officer

Acting Commissioner of Patents and Trademarks